US008130070B2

(12) United States Patent
Shibata

(10) Patent No.: US 8,130,070 B2
(45) Date of Patent: Mar. 6, 2012

(54) MULTIPLE FUSE DEVICE FOR A VEHICLE

(75) Inventor: Hideki Shibata, Kasamatsu (JP)

(73) Assignee: Pacific Engineering Corporation, Ogaki (JP)

( * ) Notice: Subject to any disclaimer, the term of this patent is extended or adjusted under 35 U.S.C. 154(b) by 770 days.

(21) Appl. No.: 12/049,388

(22) Filed: Mar. 17, 2008

(65) Prior Publication Data

US 2011/0095859 A1 Apr. 28, 2011

(30) Foreign Application Priority Data

Mar. 15, 2007 (JP) ..... 2007-066015

(51) Int. Cl.

| | |
|---|---|
| ***H01H 85/04*** | (2006.01) |
| ***H01H 85/12*** | (2006.01) |
| ***H01H 69/02*** | (2006.01) |
| ***H01R 13/46*** | (2006.01) |

(52) U.S. Cl. ..... 337/283; 337/290; 337/229; 337/161; 29/623; 439/893

(58) Field of Classification Search ..... 337/283, 337/290, 159, 161, 229, 293; 439/893; 29/623
See application file for complete search history.

(56) References Cited

U.S. PATENT DOCUMENTS

| | | | | |
|---|---|---|---|---|
| 4,531,806 | A * | 7/1985 | Hsieh | 439/620.29 |
| 5,474,475 | A * | 12/1995 | Yamaguchi | 439/620.27 |
| 5,661,448 | A * | 8/1997 | Totsuka et al. | 337/160 |
| 5,795,193 | A * | 8/1998 | Yang | 439/620.27 |
| 5,802,703 | A * | 9/1998 | Totsuka et al. | 29/623 |
| 5,977,859 | A * | 11/1999 | Kawamura et al. | 337/295 |
| 6,018,288 | A * | 1/2000 | Waite et al. | 338/254 |
| 6,069,553 | A * | 5/2000 | Black et al. | 338/215 |
| 6,402,569 | B1 * | 6/2002 | Spadoni et al. | 439/723 |
| 6,476,705 | B1 * | 11/2002 | Betti et al. | 337/161 |
| 6,759,938 | B2 * | 7/2004 | Matsumura et al. | 337/161 |
| 6,824,430 | B2 * | 11/2004 | Matsumura et al. | 439/620.29 |
| 6,830,482 | B2 * | 12/2004 | Matsumura et al. | 439/620.27 |

(Continued)

FOREIGN PATENT DOCUMENTS

JP 61-066387 A 4/1986

(Continued)

OTHER PUBLICATIONS

International Search Report, Publication Date Apr. 15, 2008.

*Primary Examiner* — Jayprakash N Gandhi
*Assistant Examiner* — Bradley Thomas
(74) *Attorney, Agent, or Firm* — Hiroe & Associates; Taras P. Bemko

(57) ABSTRACT

A multiple fuse device for a vehicle includes a circuit board with a battery-side bus bar portion and an alternator-side bus bar portion connected together by a temporary joint portion at a position apart from a fusing portion that provides charging current protection. An insulator housing is placed over the circuit board but the temporary joint portion is left uncovered by the insulator housing. A temporary joint portion is then at least partially removed. This partial removal may leave behind two temporary joint portion remnants, one on the battery-side bus bar portion, and one on the alternator-side bus bar portion. The temporary joint portion thus enhances the strength of the circuit board while the fuse device is being manufactured, which prevents the fusing portion from being accidentally deformed or broken during the device's assembly.

14 Claims, 7 Drawing Sheets

U.S. PATENT DOCUMENTS

| | | | | |
|---|---|---|---|---|
| 7,071,808 | B2 * | 7/2006 | Nakamura | 337/256 |
| 7,420,453 | B2 * | 9/2008 | Matsumura et al. | 337/295 |
| 7,612,647 | B2 * | 11/2009 | Onoda et al. | 337/229 |
| 2003/0022536 | A1 * | 1/2003 | Saito et al. | 439/76.2 |
| 2004/0032703 | A1 * | 2/2004 | Ikeda | 361/104 |
| 2004/0124963 | A1 * | 7/2004 | Nakamura | 337/256 |
| 2004/0130430 | A1 * | 7/2004 | Matsumura et al. | 337/181 |
| 2005/0285709 | A1 * | 12/2005 | Matsumura et al. | 337/227 |
| 2008/0050981 | A1 * | 2/2008 | Pavlovic et al. | 439/701 |

FOREIGN PATENT DOCUMENTS

| | | | |
|---|---|---|---|
| JP | 03-112025 | A | 5/1991 |
| JP | 07-245040 | A | 9/1995 |
| JP | 11-086661 | A | 3/1999 |
| JP | 2000-182506 | A1 | 6/2000 |
| JP | 2001-054223 | A1 | 2/2001 |
| JP | 2002-329454 | A1 | 11/2002 |
| JP | 2004-186005 | A1 | 2/2004 |
| JP | 2004-127697 | A1 | 4/2004 |
| JP | 2004-127698 | A1 | 4/2004 |
| JP | 2004-213906 | A1 | 7/2004 |
| JP | 2004-265766 | A1 | 9/2004 |
| JP | 2006-313686 | A1 | 11/2006 |
| JP | 2007-288934 | A1 | 1/2007 |
| JP | 2007-043827 | A1 | 2/2007 |
| JP | 2007-059254 | A1 | 3/2007 |
| JP | 2007-059255 | A1 | 3/2007 |

* cited by examiner

Fig. 6(a1)
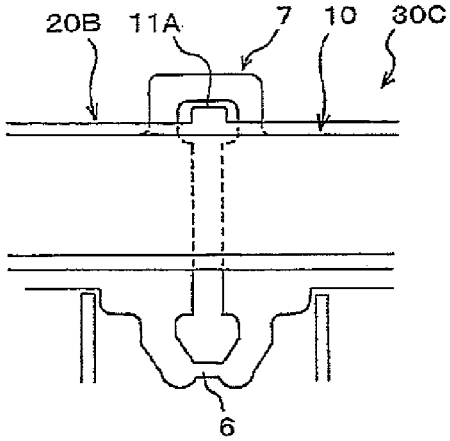
Fig. 6(b1)
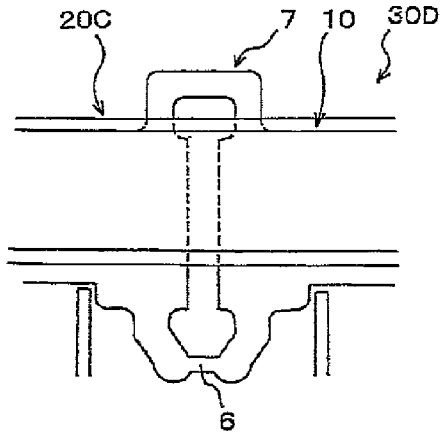
Fig. 6(a2)
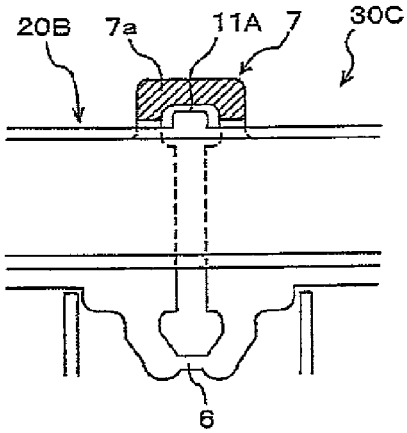
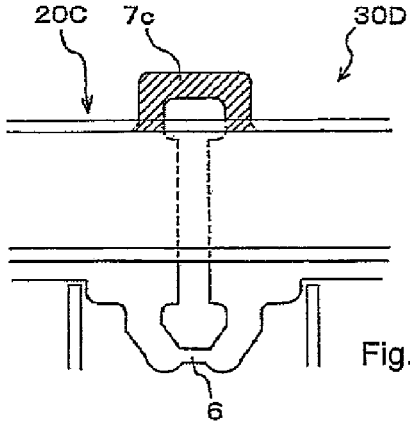
Fig. 6(b2)
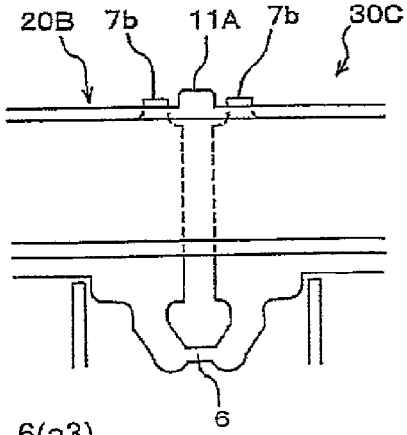
Fig. 6(a3)
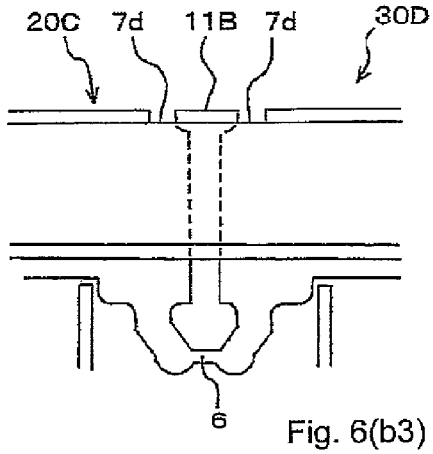
Fig. 6(b3)

MULTIPLE FUSE DEVICE FOR A VEHICLE

BACKGROUND OF THE INVENTION

The present invention relates to a multiple fuse device for a vehicle, which is intended to be mounted on a vehicle, which in use is housed in a fuse box, and which has a structure in which a battery-side bus bar portion and an alternator-side bus bar portion each including a plurality of input/output terminals via individual fusing portions are connected to each other by a fusing portion for charging current protection.

The multiple fuse device for a vehicle of the present invention is intended for use in a vehicle, and is applicable to the industrial field in which it is required to prevent a fusing portion for charging current protection from being deformed or broken during the device's assembly.

Multiple fuse devices for vehicles exist which have structures in which a battery-side bus bar portion, connected to a battery and including a plurality of input/output terminals via individual fusing portions, and an alternator-side bus bar portion, connected to an alternator and including a plurality of input/output terminals via individual fusing portions, are connected to each other by a fusing portion for charging current protection.

A thus-structured multiple fuse device for a vehicle has a fuse function for preventing overcurrent from flowing through the load equipment connected to the respective input/output terminals, which disconnects the circuit through the protection of the fusing portion for charging current if the charging current from the alternator to the battery becomes excessive. That is, the fusing portion for charging current protection connecting the battery-side bus bar portion and the alternator-side bus bar portion to each other is a portion indispensable for this fuse device.

Among the multiple fuse devices for vehicles such as those described above, the present invention is especially applied to a multiple fuse device which includes a circuit board for achieving a fuse function. This circuit board is made of copper alloy plate member, which is punched to create a battery-side bus bar portion, an alternator-side bus bar portion, a fusing portion for charging current protection, and the like. In this case, since all the circuitry shapes (circuitry patterns) including the fusing portions can be formed at one time, it is also advantageous in terms of cost.

An exemplary multiple fuse device for a vehicle such as described above is suggested in Japanese Laid-Open Patent Publication No. 2001-054223.

FIG. 7 of the present document shows a multiple fuse device for a vehicle that constitutes background art for the present invention.

FIG. 7 shows a circuit board 50 of the multiple fuse device for a vehicle that is described above. The circuit board 50 is formed by punching a copper alloy plate member to form a structure in which a battery-side bus bar portion 44 including a plurality of input/output terminals 42 via individual fusing portions 41 and an alternator-side bus bar portion 45 including a plurality of input/output terminals 42 via individual fusing portions 41 are connected to each other by a fusing portion 46 for charging current protection. The battery-side bus bar portion 44 includes a battery connection terminal 44*a*; the alternator-side bus bar portion 45 includes an alternator connection terminal 45*a*.

The circuit board 50, having the structure described above, permits the above-described multiple fuse device to perform its function and have its effect. However, although the fusing portion 46 for charging current protection is a narrow and weak portion, it interconnects the battery-side bus bar portion 44 and the alternator-side bus bar portion 45, each of which includes a plurality of input/output terminals 42 and the like. There is a possibility that the fusing portion 46 for charging current protection may be deformed or broken during an assembly step in which the circuit board 50 is covered and insulated by an insulator housing. The same problem of deformation and breakage may possibly arise in the individual fusing portions 41.

However, the invention of Japanese Laid-Open Patent Publication No. 2001-054223 is intended to solve problems that resulted from contact failure and the increased size of the fuse device, and has no description as to the problem arising in the assembly, much less as to the means for solving such a problem. Japanese Laid-Open Patent Publication No. 2004-213906 suggests a multiple fuse device for a vehicle including the fusing portion for charging current protection and individual fusing portions, similarly to Japanese Laid-Open Patent Publication No. 2001-054223. However, in Japanese Laid-Open Patent Publication No. 2004-213906 as well, there is neither a recognition of such a problem nor a description as to means for solving such a problem.

SUMMARY OF THE INVENTION

The present invention is intended to solve the problems described above, and an objective thereof is to provide a multiple fuse device for a vehicle whose fusing portion for charging current protection is neither deformed nor broken during the device's assembly.

An embodiment of this invention, namely a multiple fuse device for a vehicle, includes a circuit board, and an insulator housing, which covers and insulates the circuit board. The circuit board is formed by punching a copper alloy plate member to create a battery-side bus bar portion and an alternator-side bus bar portion, each of which includes a plurality of input/output terminals connected via individual fusing portions. The battery-side bus bar portion and the alternator-side bus bar portion are connected together by a fusing portion for charging current protection. The battery-side bus bar portion includes a battery-connection terminal and the alternator-side bus bar portion includes an alternator connection terminal. The battery-side bus bar portion and the alternator-side bus bar portion are additionally connected together at a position different from the position of the fusing portion for charging current protection by a temporary joint portion that is left uncovered by the insulator housing. The temporary joint portion is then at least partially removed after the circuit board is covered with the insulator housing.

The temporary joint portion reinforces the strength of the circuit board and prevents the fusing portion for charging current protection from being deformed and broken during the fuse device's manufacture.

In another embodiment of this invention, the fusing portion for charging current protection interposed between individual fusing portions of the battery-side bus bar portion and the alternator-side bus bar portion.

The insulator housing can be formed easily and conveniently as a simple rectangular element.

The battery-side bus bar portion and the alternator-side bus bar portions can be located in a single flat plane, have the same thickness and width as each other, and be located along a single straight line in their respective longitudinal directions.

The device is simple in structure, and its elements are simple to form and easy to handle.

The circuit board may include individual temporary input/output terminal connectors that connect a plurality of adjacent input/output terminals to each other at positions apart from the position of an individual fusing portion. The individual temporary input/output terminal connectors are left uncovered by the insulator housing, and will be removed after the insulator housing is installed over the circuit board.

This decreases the possibility that the input/output terminals, each of which extends from a relatively narrow and therefore weak individual fusing portion, might be deformed or broken during the device's manufacture.

The temporary joint portion may be provided in a recess, which is recessed from the outer edge of the insulator housing. After the temporary joint portion is partially removed, a pair of temporary joint portion remnants may remain behind inside the recessed portion of the insulator housing.

The temporary joint portion remnants are thereby protected from hooking objects on the outside of the housing, and contact from the outside is thereby guarded against.

The insulator housing may include a short-circuit inhibiting portion at an intermediate position between a pair of remainder portions that remain after a partial removal of the temporary joint portion, for inhibiting short-circuits between the remaining portions.

This means that even if a screwdriver or another tool is accidentally brought into contact with either one of the remnants, the tool is never brought into contact with both of the remnants simultaneously. A short-circuit between the remnants can thereby be avoided.

BRIEF DESCRIPTION OF THE DRAWINGS

Principles of the invention can be best understood from the following description read in connection with the appended drawing figures, in which:

FIGS. 6(*a*1)-6(*a*3) are frontal views with essential parts showing another exemplary process of assembling a multiple fuse device for a vehicle of the present invention. FIGS. 6(*b*1)-6(*b*3) are frontal views with essential parts showing still another process for assembling a multiple fuse device for a vehicle of the present invention.

DETAILED DESCRIPTION OF PREFERRED EMBODIMENTS

Hereinafter, embodiments (examples) of the present invention will be described in connection with the drawings.

Figure 1A:
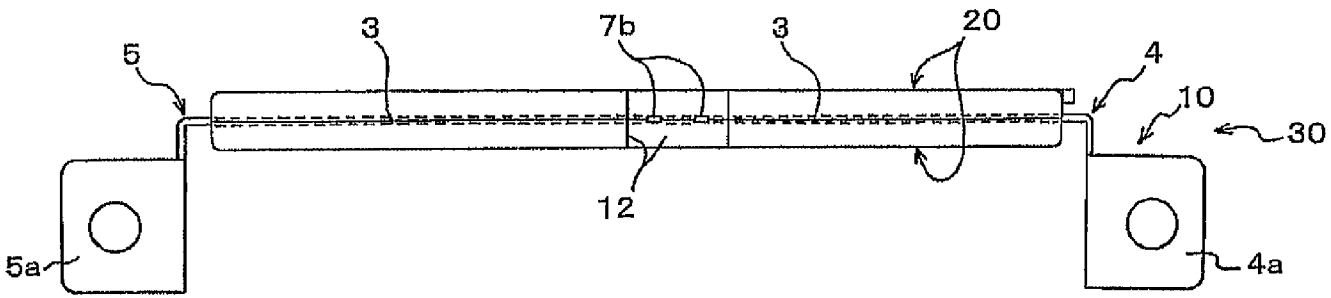
FIGS. 1(*a*)-1(*c*) show one exemplary multiple fuse device for a vehicle, where FIG. 1(*a*) is a plan view thereof, FIG. 1(*b*) is a frontal view thereof, and FIG. 1(*c*) is a side view thereof.
Figure 1B:
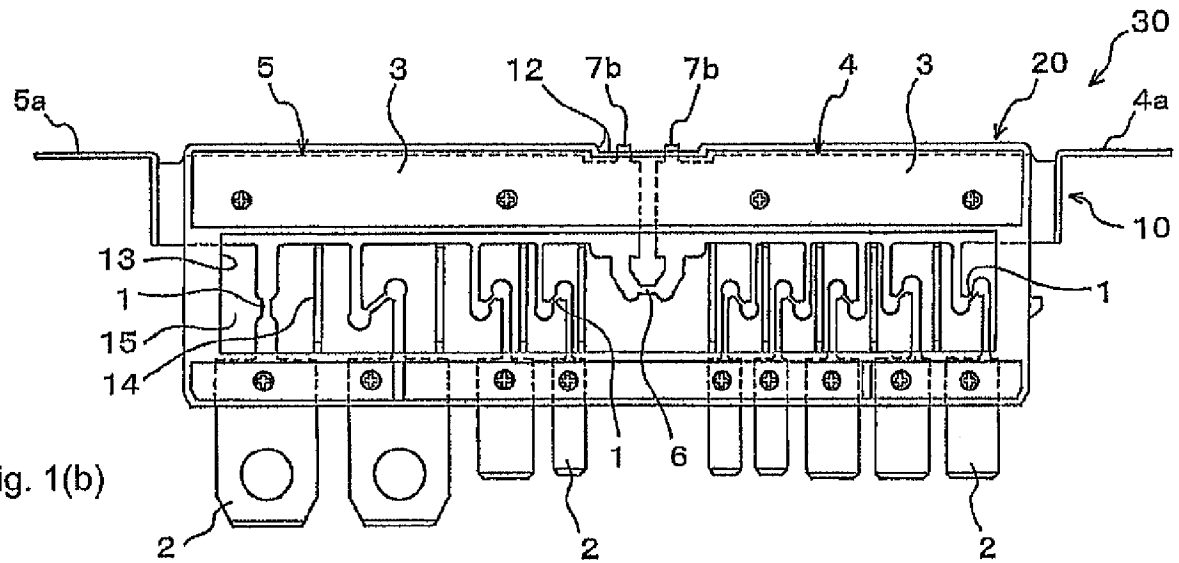
Figure 1C:
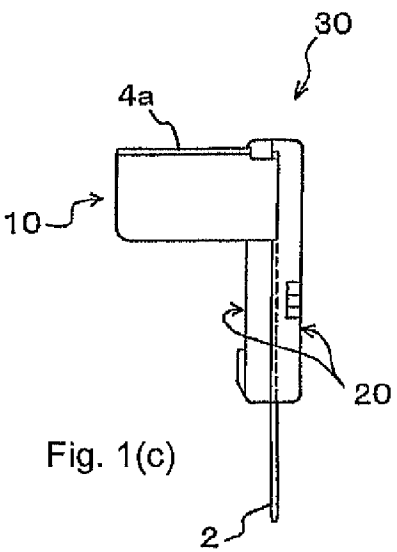
Figure 2A:
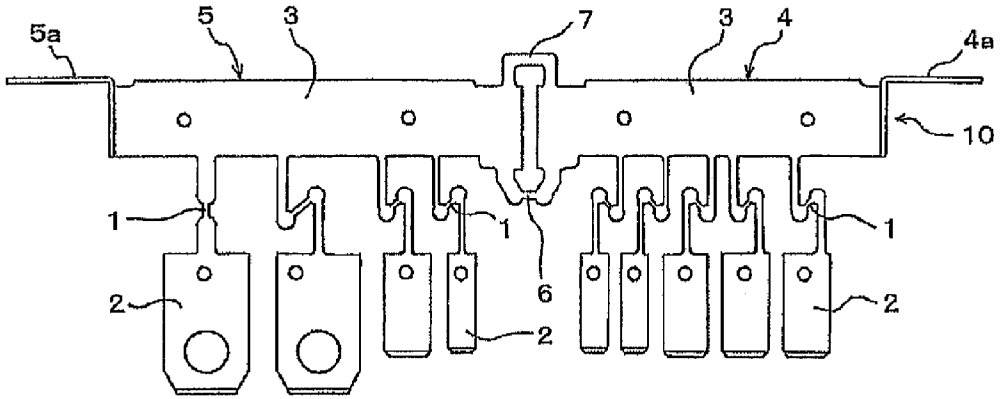
FIGS. 2(*a*)-2(*d*) show a process for assembling the multiple fuse device for a vehicle shown in FIGS. 1(*a*)-1(*c*), where FIG. 2(*a*) is a frontal view showing a prepared circuit board, FIG. 2(*b*) is a frontal view showing a state in which the circuit board of FIG. 2(*a*) is covered with an insulator housing, FIG. 2(*c*) is a cross-sectional view taken along line A-A in FIG. 2(*b*), and FIG. 2(*d*) is a partially enlarged view showing a state in which a temporary joint portion is removed from the assembly shown in FIG. 2(*b*) over a predetermined segment.
Figure 2C:
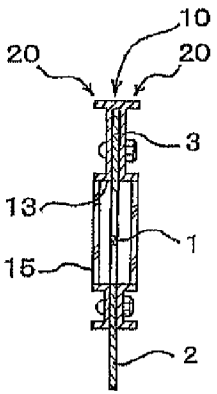
Figure 2B:
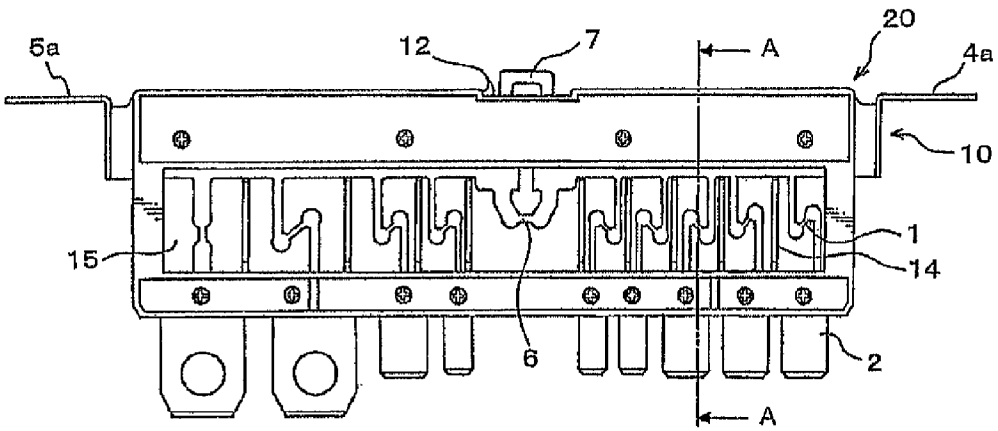
Figure 2D:
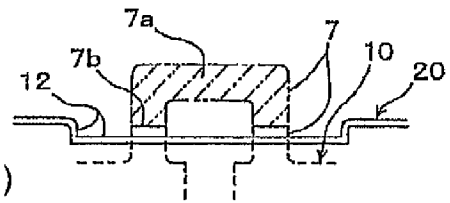

FIGS. 1(*a*)-1(*c*) show one exemplary multiple fuse device for a vehicle, in which FIG. 1(*a*) is a plan view thereof, FIG. 1(*b*) is a frontal view thereof, and FIG. 1(*c*) is a side view thereof.

The multiple fuse device 30 for a vehicle includes a circuit board 10, and an insulator housing 20 for covering and insulating the circuit board 10. The circuit board 10 is formed by punching a copper alloy plate member to create a battery-side bus bar portion 4 and an alternator-side bus bar portion 5, each including a plurality of input/output terminals 2 via individual fusing portions 1, wherein the bus bar portion 4 and the bus bar portion 5 are connected to each other by a fusing portion 6 for charging current protection. The multiple fuse device 30 for a vehicle is mainly to be mounted on a vehicle, and in use, is housed in a fuse box.

The battery-side bus bar portion 4 includes a battery-connection terminal 4*a* for connection with a battery (not shown). The alternator-side bus bar portion 5 includes an alternator-side connection terminal 5*a* for connection with an alternator (a generator for a vehicle, not shown).

In the basic structure described above, the multiple fuse device 30 for a vehicle is characterized in that the battery-side bus bar portion 4 and the alternator-side bus bar portion 5 are connected to the circuit board 10 at a position different from the position of the fusing portion 6 for charging current protection, that is, at a portion which will be left uncovered by the insulator housing 20. The multiple fuse device 30 for a vehicle is also characterized in that it has a temporary joint portion 7 which will be removed over a predetermined segment after the circuit board 10 is covered with the insulator housing 20.

In FIGS. 1(*a*)-1(*c*), the temporary joint portion 7 (see FIG. 2(*a*)) has already been removed over a predetermined segment, and portions 7*b* that remain after that removal are seen. The temporary joint portion 7 will be described later in detail in connection with FIGS. 2(*a*)-2(*c*).

The multiple fuse device 30 for a vehicle includes, in addition to the members described above, a linking portion 3 as a constituent element of the circuit board 10. The linking portion 3 links the battery-side bus bar portion 4 and the alternator-side bus bar portion 5 with a plurality of input/output terminals 2 via their individual fusing portions 1, and also a battery connection terminal 4*a* and an alternator connection terminal 5*a*, respectively.

Further, the temporary joint portion 7 is provided at a recessed portion 12 which is recessed from the outer edge of the insulator housing 20. As is illustrated in FIG. 1(*b*), the remaining portions 7*b* do not protrude out of the recessed portion 12.

The insulator housing 20 includes a housing portion 13 for housing a plurality of individual fusing portions 1, and a fusing portion 6 for charging current protection provided at one place. The housing portion 13 includes partitioning walls 14, each located between adjacent individual fusing portions 1.

In this structure, the fusing portion 6 for charging current protection is arranged to be adjacently interposed between the individual fusing portions 1 of the battery-side bus bar portion 4 and the individual fusing portion 1 of the alternator-side bus bar portion 5. Thus, the housing portion 13 can be formed as a rectangular space portion such as illustrated, so that its structure can be simplified.

Further, at the opposite sides which are opened sides of the housing portion 13 (i.e. at the obverse and reverse sides of the drawing page of FIG. 1(*b*)), there is a transparent cover 15 through which it is possible to check whether or not the individual fusing portions 1 have been fused and also to enhance the security when fusing occurs. The cover 15 also may be structured as a simple rectangular plate to match the simple rectangular shape of the housing portion 13.

As has already been described above, the material of the circuit board 10 is a plate member made of copper alloy. The material of the insulator housing 20 is not specifically limited as long as it is an insulator. In view of moldability, cost, and the like, the material of the insulator housing 20 is preferably a synthetic resin, and especially, a polyamide-based resin.

Hereinafter, the functions and effects of the multiple fuse device 30 for a vehicle structured as described above will be described in connection with FIGS. 2(*a*)-2(*c*).

FIGS. 2(*a*)-2(*c*) show a process of assembling the multiple fuse device for a vehicle shown in FIGS. 1(*a*)-1(*c*), in which FIG. 2(*a*) is a frontal view showing a prepared circuit board, FIG. 2(*b*) is a frontal view showing a state in which the circuit board of FIG. 2(*a*) is covered with an insulator housing, FIG. 2(*c*) is a cross-sectional view taken along line A-A in FIG. 2(*b*), and FIG. 2(*d*) is a partially enlarged view showing a state in which a temporary joint portion is removed from the state shown in FIG. 2(*b*) over a predetermined segment.

In assembling the multiple fuse device 30 for a vehicle of FIGS. 1(*a*)-1(*c*), a circuit board 10 such as that shown in FIG. 2(*a*) is first prepared.

The circuit board 10 is obtained in the following manner. A copper alloy plate member is punched to form a battery-side bus bar portion 4, an alternator-side bus bar portion 5, a fusing portion 6 for charging current protection and a temporary joint portion 7 for joining these bus bar portions 4 and 5 to each other, a battery connection terminal 4*a*, and an alternator connection terminal 5*a*. After that, the battery connection terminal 4*a* and the alternator connection terminal 5*a* are formed by being bent into the shapes shown in FIGS. 1(*a*)-1(*c*).

Therefore, all of the portions other than the battery connection terminal 4*a* and the alternator connection terminal 5*a* which are formed by bending, that is, all of the individual fusing portions 1, the input/output terminals 2, the linking portions 3, the fusing portion 6 for charging current protection, and the temporary joint portion 7 are located in the same flat plane, and have a flat planar shape.

Further, the battery-side bus bar portion 4 and the alternator-side bus bar portion 5 have the same plate thickness and width as each other, and are located along one straight line in their respective longitudinal directions. Thus, they are simple in structure, their shapes can be easily formed, and they are easy to handle.

Here, as is understood from FIG. 2(*a*), the battery-side bus bar portion 4 and the alternator-side bus bar portion 5 are connected to each other not only by the fusing portion 6 for charging current protection, but also by the temporary joint portion 7. As a result, they are connected to each other at two locations, and thus, the circuit board 10 has high strength as a whole, which prevents the fusing portion 6 for charging current protection from being deformed and broken during the device's assembly.

Since the temporary joint portion 7 is a portion that will be removed later, this portion is not required to be narrow, unlike the fusing portion 6 for charging current protection, which must be narrow to achieve its fuse function. Thus, the temporary joint portion 7 may be formed wide if necessary. When the temporary joint portion 7 is formed wide, the strength of the circuit board 10 can be further enhanced, thereby more assuredly avoiding deformation or breakage of the fusing portion 6 for charging current protection.

Next, as is shown in FIG. 2(*b*), the flat surface portion of the circuit board 10 is covered and insulated by the insulator housing 20 while keeping the portions for use in connection to the input/output terminals 2 and the temporary joint portion 7 left uncovered. In this example, the circuit board 10 is tightened at every key position by screws in a state where the circuit board 10 is pinched by the flat plane-like insulator housing 20. As a result, the circuit board 10 and the insulator housing 20 are combined into a one piece integral unit, and together constitute a structure that strongly maintains its flat surface state.

In this state, the battery-side bus bar portion 4 and the alternator-side bus bar portion 5 are brought into a state where they are mutually at fixed positions, and load will never be applied to the fusing portion 6 for charging current protection. Therefore, when this state has been reached, the role of the temporary joint portion 7 as a temporary linking means for both the bus bars is ended.

Then, as shown in FIG. 2(*d*), the temporary joint portion 7 is removed over a predetermined segment. (In the illustration, the portion to be removed is marked with oblique double-dot chain lines and is specified herein as "a removal portion 7*a*".) As a result, the connection between the battery-side bus bar portion 4 and the alternator-side bus bar portion 5 disappears, and these bus bar portions 4 and 5 are connected to each other only at the fusing portion 6 for charging current protection. As a result, the fusing portion 6 for charging current protection can then play its intended role.

Here, the temporary joint portion 7 is structured so that it is not covered with the insulator housing 20, and a remaining portion 7*b* that remains after the removal of the removal portion 7*a* protrudes out of the insulator housing 20.

If the remaining portion 7*b* is formed to protrude out of the insulator housing 20 to some height as described above, it becomes possible to remove the removal portion 7*a* without touching the insulator housing 20 at the time of removal. Thus, the removal is more easily carried out.

Further, the remaining portion 7*b* is cut and removed in such a manner that it never protrudes out of the recessed portion 12 for temporary joint portion. Thus, the remaining portion does not become a hook liable to contact from the outside, and the possibility that a conductor comes into contact from the outside can thereby be reduced.

As a result, the multiple fuse device 30 for a vehicle shown in FIGS. 1(*a*)-1(*c*) is obtained. As described above, the thus-obtained multiple fuse device 30 for a vehicle includes the temporary joint portion 7, so that it reduces the occurrence of the problem that the fusing portion 6 for charging current protection is deformed or broken during the device's assembly.

Figure 3A:
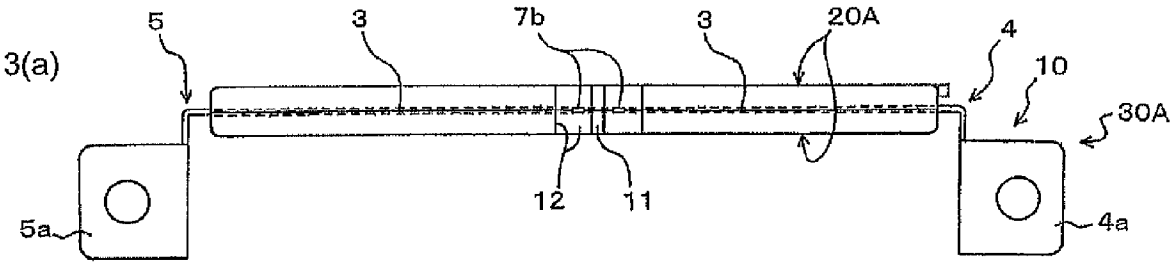
FIG. 3(*a*) is a plan view showing another example of a multiple fuse device for a vehicle of the present invention, FIG. 3(*b*) is a frontal view with its essential part enlarged, and FIG. 3(*c*) is a frontal view thereof.
Figure 3B:
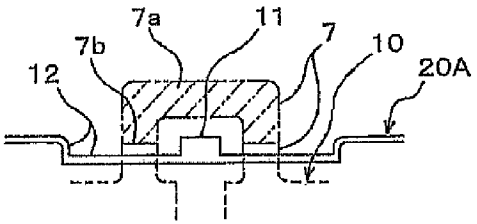
Figure 3C:
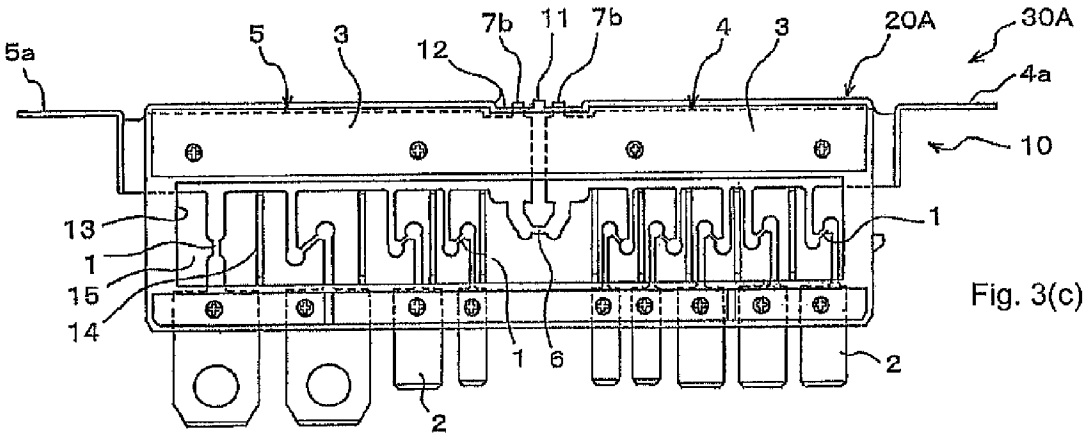

FIG. 3(*a*) is a plan view showing another example of a multiple fuse device for a vehicle of the present invention. FIG. 3(*b*) is a frontal view with its essential part enlarged, and FIG. 3(*c*) is a frontal view thereof. Hereinafter, the elements that are the same as those already described above are denoted by the same reference numerals, and overlapping descriptions will be omitted.

The multiple fuse device 30A for a vehicle differs from the multiple fuse device 30 for a vehicle described with reference to FIGS. 1(*a*)-1(*c*) and 2(*a*)-2(*c*) in that an insulator housing 20A includes a short-circuit inhibiting portion 11 located at an intermediate position between a pair of remnants 7*b*, for inhibiting a short-circuit between the remnants 7*b*.

In this embodiment, as in the case of the multiple fuse device 30 for a vehicle, a temporary joint portion 7 is provided at a recessed portion 12, and accordingly, the short-circuit inhibiting portion 11 is also provided at this recessed portion 12. However, as will be described later, the short-circuit inhibiting portion 11 may be at any position between a pair of remnants 7*b*, and is not necessarily required to be located in the recessed portion of the insulator housing.

Figure 4A:
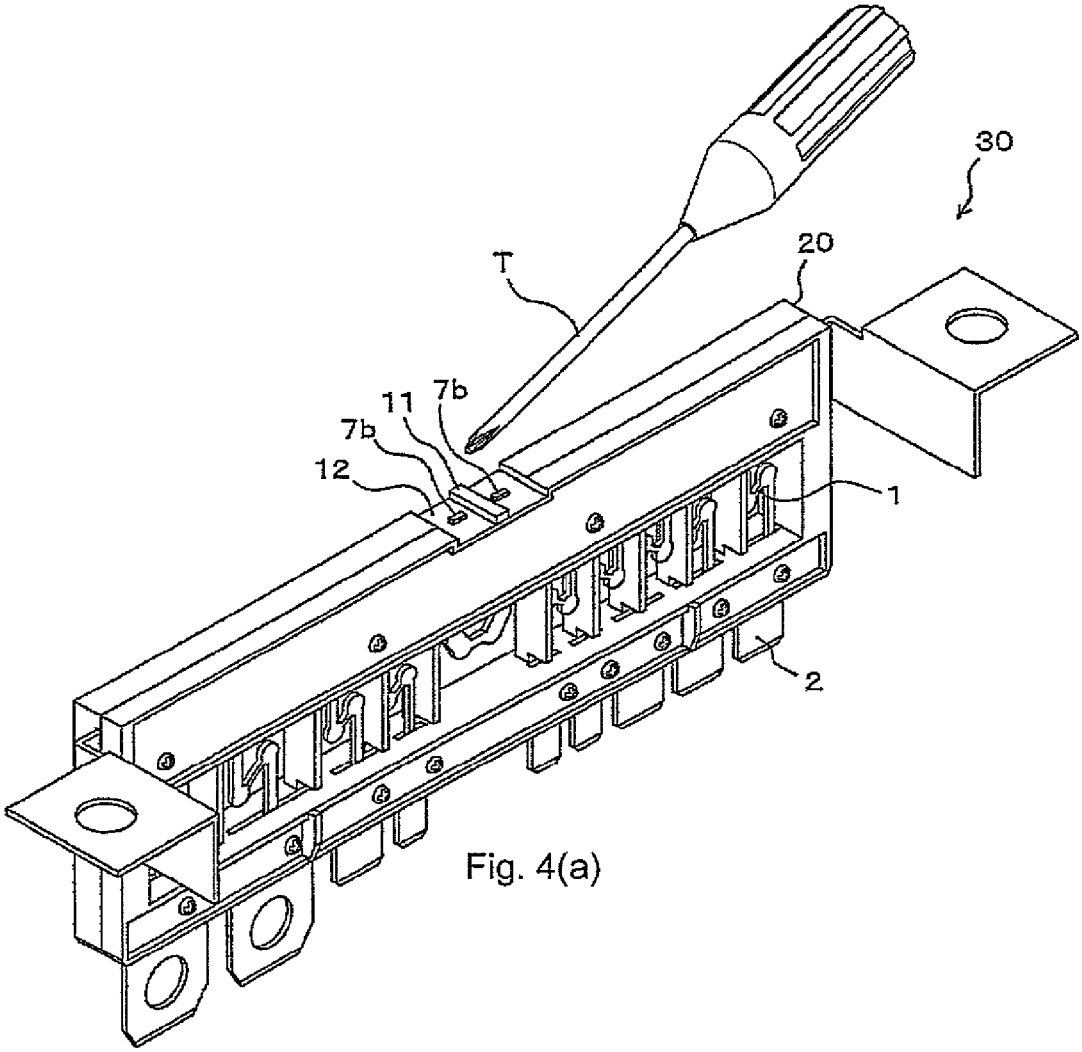
FIG. 4(*a*) is a perspective view showing the outward appearance of the multiple fuse device for a vehicle shown in FIG. 3 in use, and FIG. 4(*b*) is a partially enlarged view illustrating a portion of the device shown in FIG. 4(*a*)
Figure 4B:
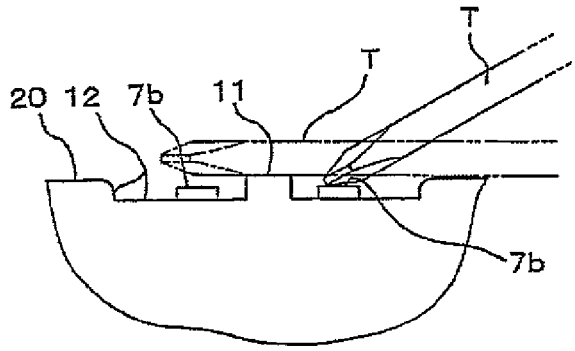

FIG. 4(*a*) is a perspective view showing the outward appearance of the multiple fuse device for a vehicle shown in FIG. 3 in use. FIG. 4(*b*) is a partially enlarged view illustrating a portion of the device shown in FIG. 4(*a*).

The multiple fuse device 30A for a vehicle exhibits not only the same function and effect as that of the multiple fuse device 30 for a vehicle described above, but also the effect achieved by the short-circuit inhibiting portion 11 protruding from the intermediate portion between a pair of remnants 7*b* as shown in FIGS. 4(*a*) and 4(*b*), even if the remnants 7*b* (which are conductors) remaining after the removal portion 7*a* is removed from the temporary joint portion 7 protrude out of the insulator housing 20.

That is, as is illustrated as an example in FIG. 4(*b*), even if the top end portion of a tool T such as a screwdriver is accidentally brought into contact with either of the remnants 7*b*, it is never brought into contact with both of the remnants 7*b* simultaneously. Thus, a short-circuit between the remnants 7*b* can be avoided.

Further, a pair of remnants 7*b* and the short-circuit inhibiting portion 11 are located in the recessed portion 12, which is depressed from the outer edge portion of the insulator housing 20. Owing to this structure, a short-circuit preventing function is more excellently exhibited.

Figure 5A:
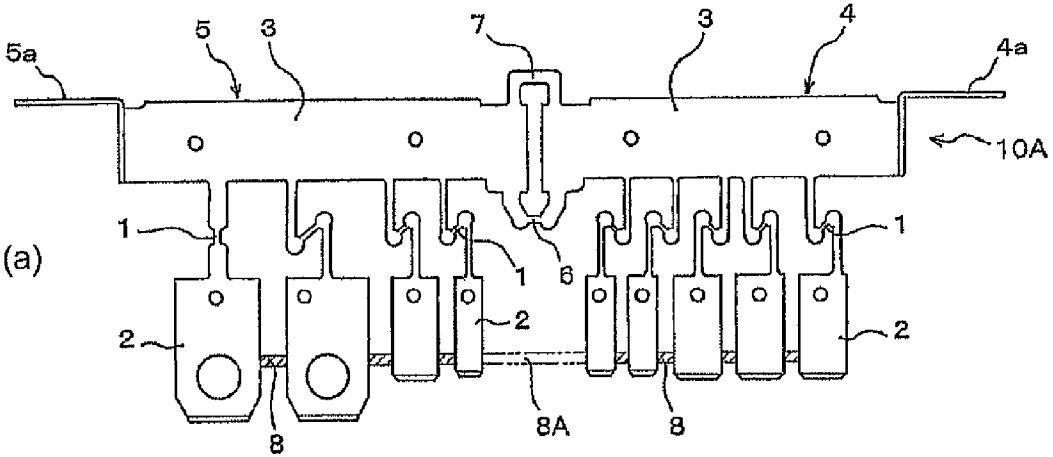
FIGS. 5(*a*) and 5(*b*) are frontal views showing another exemplary circuit board that is a constituent element of the multiple fuse device for a vehicle of the present invention.
Figure 5B:
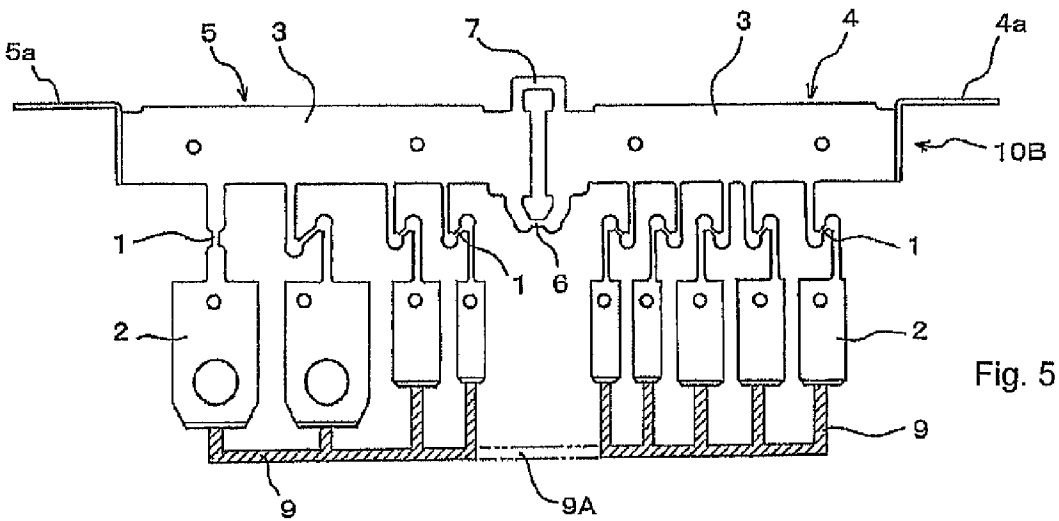
Figure 7:
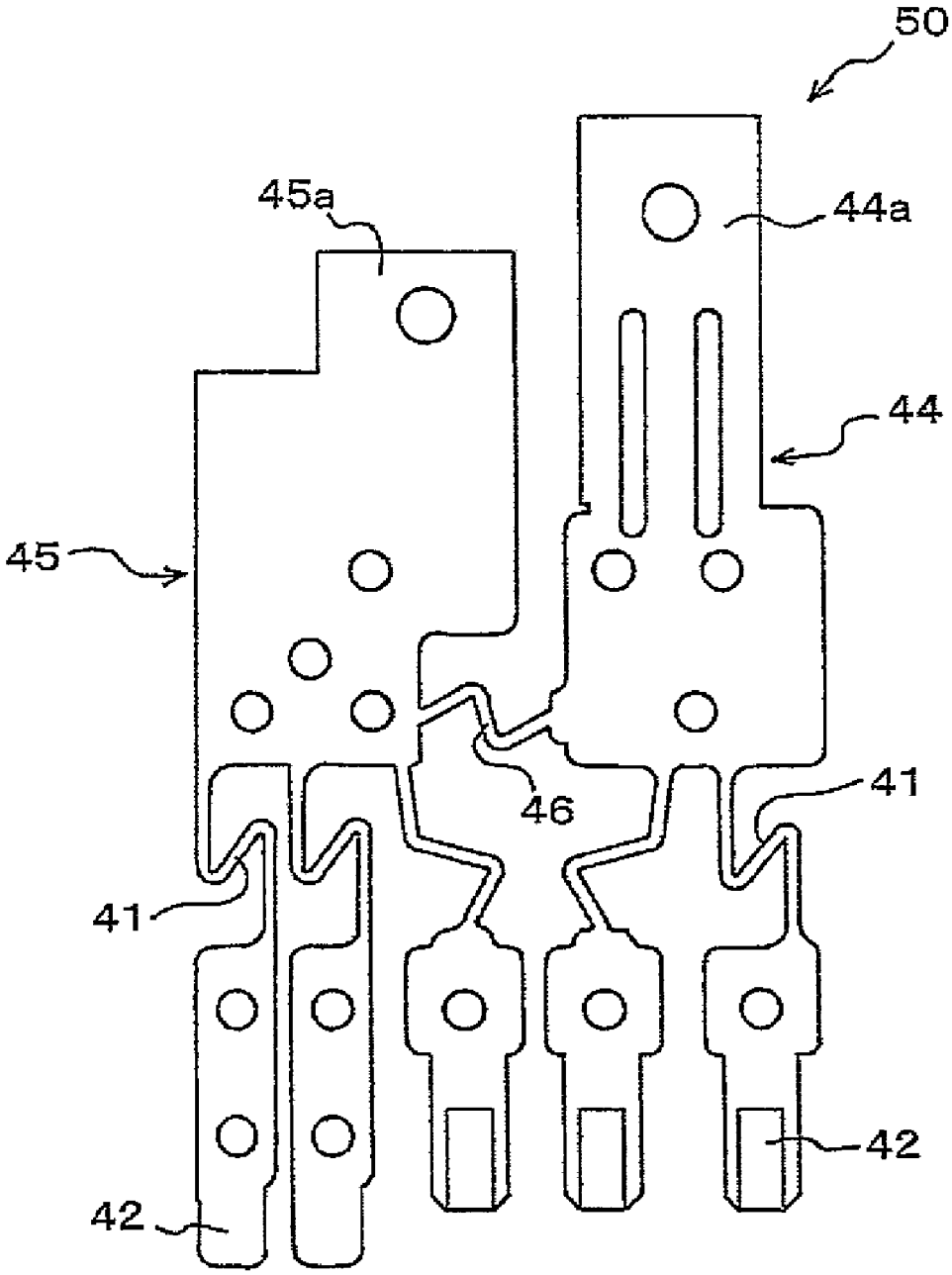
Fig. 7 (Prior Art)
FIG. 7 shows the multiple fuse device for a vehicle which constitutes background art to the present invention.

FIGS. 5(*a*) and 5(*b*) are frontal views showing another exemplary circuit board that is a constituent element of the multiple fuse device for a vehicle of the present invention.

The circuit board 10A of FIG. 5(*a*) differs from the circuit board 10 shown in FIG. 2(*a*) in that it includes individual temporary joint portions 8 which connect a plurality of adjacent input/output terminals 2 to each other at positions different from the positions of individual fusing portions 1, which are portions that will be left uncovered with the insulator housing 20, and which will be removed after the circuit board 10A is covered with an insulator housing 20. Each individual joint portion 8 is formed to connect the sides of input/output terminals 2 to each other.

In the manner described above, the possibility that the input/output terminals 2, each extending from an individual fusing portion 1 (which is narrow and weak like the fusing portion 6 for charging current protection) will be displaced or dropped out can be reduced. Therefore, these individual temporary joint portions 8 may be provided as required.

Further, in the drawings the individual temporary joint portions 8 merely interconnect the input/output terminals 2 of the battery-side bus bar portion 4, and merely interconnect the input/output terminals 2 of the alternator-side bus bar portion 5, respectively. Besides the individual temporary joint portions 8, an individual temporary joint portion 8A for connecting the battery-side input/output terminal 2 and the alternator-side input/output terminal 2 adjacent to each other may be also provided, as shown in the long dashed double-short dashed line in the drawing.

In the case where the individual temporary joint portion 8A such as described above is provided, a deformation suppressing function is more excellently exhibited. Further, even if the circuit board 10A is employed, the same insulator housing 20 as above may be employed. A multiple fuse device including the circuit board 10A and the insulator housing 20 exhibits the effect of the circuit board 10A as a fuse device.

The circuit board 10B shown in FIG. 5(*b*) differs from the circuit board 10A shown in FIG. 5(*a*) only in that individual temporary joint portions 9 are in a form that links the end sides of input/output terminals 2.

Therefore, the circuit board 10B basically exhibits the same effect as of the circuit board 10A. In this case, an individual temporary joint portion 9A shown by a long dashed double-short dashed line also exhibits the same effect as that of the individual temporary joint portion 8A.

In addition, in cutting off the temporary joint portion 9A and the circuit board 10B, the portion to be cut is only one portion, that is, an end side per input/output terminal portion 2, and thus the number of cutting steps can be reduced. Further, even if some portion of the temporary joint portion 9A is left uncut, there is no hindrance in the direction of inserting and retracting the counter-recessed terminals into and from the input/output terminals 2. Thus, lower cutting accuracy may be permitted.

Further, even in the case where the circuit board 10B is employed, the same insulator housing 20 as above may be employed. A multiple fuse device for a vehicle including the circuit board 10B and the insulator housing 20 exhibits the same effect as of the circuit board 10B as a fuse device.

FIGS. 6(*a*1)-6(*a*3) are frontal views with essential parts showing another exemplary process of assembling a multiple fuse device for a vehicle according to the present invention. FIGS. 6(*b*1)-6(*b*3) are frontal views with essential parts showing still another process for assembling a multiple fuse device for a vehicle of the present invention.

FIGS. 6(*a*1)-6(*a*3) and 6(*b*1) to 6(*b*3) are in the same order as FIGS. 2(*b*), 2(*c*), and 1(*b*) related to Embodiment 1, and the assembly process and the completed state in the respective embodiments are shown by way of the fusing portion for charging current protection and the temporary joint portion in the expanded drawings.

The multiple fuse device 30C for a vehicle shown in FIGS. 6(*a*1)-6(*a*3) differs from the multiple fuse devices 30 and 30A for a vehicle shown in FIGS. 1(*a*)-1(*c*), 2(*a*)-2(*c*), and 3(*a*) and 3(*b*) in that a pair of remaining portions 7*b* and a short-circuit inhibiting portion 11A are provided at an outer edge portion (i.e., a flat portion) of an insulator housing 20B.

In the manner described above, even where a pair of remaining portions 7*b* and the short-circuit inhibiting portion 11A are not provided in a recessed portion 12 for temporary joint portion, the short-circuit inhibiting portion 11A exists between the pair of remaining portions 7*b* and sufficiently exhibits its short-circuit inhibiting function.

A multiple fuse device 30D for a vehicle shown in FIGS. 6(*b*1)-6(*b*3) differs from the multiple fuse device 30 for a vehicle shown in FIGS. 1(*a*)-1(*c*) and 2(*a*)-2(*c*) in that there is no recessed portion 12 for a temporary joint portion at the outer edge portion of the insulator housing 20C, and in removing the temporary joint portion 7, the removal extends even to the outer edge portions of the insulator housing 20C to remove also the portions of the insulator housing 20C together with the removal portion 7*c*.

In the manner as described above, each of remaining portions 7*d* comes into the state where it is interposed by the insulator housing 20C at the portion recessed to the depth from the outer edge portion of the flat insulator housing 20C and never protrudes. As a result, the insulator housing 20C interposed by the remaining portions 7*d* results in protruding and serving as a short-circuit inhibiting portion 11B that inhibits the mutual short-circuit between the remaining portions 7*d*.

Therefore, the short-circuit inhibiting portion 11B can be formed also by way of this method, and the same effect as of the short-circuit inhibiting portion 11 shown in FIGS. 3(*a*)-3(*c*) can be exhibited.

The present invention has been described based on certain specific embodiments. However, various improvements and modifications may be made to these embodiments, and these improvements and modifications are also encompassed within the technical range of the present invention.

What is claimed is:

1. A multiple fuse device assembly comprising:

a circuit board;

an insulator housing that covers and insulates at least a part of the circuit board; and the circuit board comprising:

a battery-side bus bar portion including a battery-connection terminal; and an alternator-side bus bar portion including an alternator-side connection terminal, wherein each of said bus bar portions includes a plurality of input/output terminals, each of said input/output terminals connected to an individual fusing portion, and wherein the battery-side bus bar portion and the alternator-side bus bar portion are connected together by a charge current protection fusing portion, and wherein the battery-side bus bar portion and the alternator-side bus bar portion are additionally connected together at a location away from the charge current protection fusing portion by a temporary joint portion, and wherein the temporary joint portion is provided at a recessed portion which is recessed from an outer edge of the insulator housing, said outer edge being distal from said plurality of input/output terminals, and wherein the temporary joint portion is at least partially exposed by the insulator housing, and wherein a certain part exposed of the temporary joint portion is removed from the assembly after covering the circuit board by the insulator housing, and after completing the manufacturing process of the assembly but prior to connecting the assembly into an electrical circuit and prior to any exposure of charging current or fusing, and wherein only remaining portions remain but do not protrude out of the recessed portion.

2. The multiple fuse device assembly of claim 1, wherein the battery-side bus bar portion and the alternator-side bus bar portion are located in the same flat plane, and each has a substantially flat planar shape.

3. The multiple fuse device assembly of claim 1, further comprising at least one temporary input/output terminal connector that extends between at least two of the plurality of input/output terminals, wherein said temporary input/output terminal connector is at least partially exposed by the insulator housing and thereby configured for removal from the assembly prior to any exposure of charging current or fusing.

4. The multiple fuse device assembly of claim 1, wherein said temporary joint portion is located partially inside of the insulator housing and partially outside of the insulator housing so that a part of the temporary joint portion located outside of the insulator housing is thereby configured for removal from the assembly.

5. The multiple fuse device assembly of claim 1, wherein said temporary joint portion includes a pair of legs, one such leg on each of the battery-side bus bar portion and the alternator-side bus bar portion, with a connecting structure joining said pair of legs to one another; and further comprising an electrically insulative projecting structure on said insulator housing and between said legs of said temporary joint portion.

6. A multiple fuse device assembly comprising:

a circuit board;

an insulator housing that covers and insulates a part of the circuit board; and the circuit board comprising:

a battery-side bus bar portion including a battery-connection terminal;

an alternator-side bus bar portion including an alternator-side connection terminal; and at least two temporary joint portion remnants, said at least two temporary joint portion remnants having been left behind following the partial removal of a temporary joint portion after completing the manufacturing process of the assembly but prior to connecting the assembly into an electrical circuit and prior to any exposure of charging current or fusing, wherein before its partial removal, the temporary joint portion, had connected the battery-side bus bar portion and the alternator-side bus bar portion together between the two temporary joint portion remnants at a location away from a fusing portion for charge current protection that connects together the battery-side bus bar portion and the alternator-side bus bar portion, and wherein the temporary joint portion is provided at a recessed portion which is recessed from an outer edge of the insulator housing, said outer edge being distal from said plurality of input/output terminals, and wherein a first one of said temporary joint portion remnants is in the form of a small projection left behind on the battery-side bus bar portion, and wherein a second one of said temporary joint portion remnants is in the form of a small projection left behind on the alternator-side bus bar portion, and wherein the at least two temporary joint portion remnants do not protrude out of the recessed portion, and wherein each of said bus bar portions includes a plurality of input/output terminals, each of said input/output terminals connected to an individual fusing portion, and wherein the temporary joint portion remnants are at least partially exposed by the insulator housing.

7. The multiple fuse device assembly of claim 6, wherein the battery-side bus bar portion and the alternator-side bus bar portion are located in the same flat plane, and each has a substantially flat planar shape.

8. The multiple fuse device assembly of claim 6, wherein said temporary joint portion remnants are located at least partially inside of the recessed portion defined by a structure of the insulator housing.

9. The multiple fuse device assembly of claim 6, and further comprising an electrically insulative projecting structure on said insulator housing and between said temporary joint portion remnants.

10. A method for manufacturing a multiple fuse device, the method comprising:

forming a circuit board comprising:

a battery-side bus bar portion including a battery-connection terminal;

an alternator-side bus bar portion including an alternator-side connection terminal, wherein each of said bus bar portions includes a plurality of input/output terminals, each of said input/output terminals connected to an individual fusing portion, and wherein the battery-side bus bar portion and the alternator-side bus bar portion are connected together by a charge current protection fusing portion, and wherein the battery-side bus bar portion and the alternator-side bus bar portion are additionally connected together at a location away from the charge current protection fusing portion by a temporary joint portion;

partially covering the circuit board with an insulator housing while leaving the temporary joint portion at least partially exposed, and removing, after completing the manufacturing process of the assembly but prior to any exposure of charging current or fusing, an amount of the temporary joint portion sufficient to sever electrical conductivity through the temporary joint portion between the battery-side bus bar portion and the alternator-side bus bar portion, wherein the temporary joint portion is provided at a recessed portion which is recessed from an outer edge of an insulator housing that covers and insulates a part of the circuit board, said outer edge being distal from said plurality of input/output terminals.

11. The method of claim 10, wherein the battery-side bus bar portion and the alternator-side bus bar portion are located in the same flat plane, and each has a substantially flat planar shape.

12. The method of claim 10, wherein forming the circuit board includes forming at least one temporary input/output terminal connector that extends between at least two of the plurality of input/output terminals;

wherein partially covering the circuit board with the insulator housing includes leaving said temporary input/output terminal connector at least partially exposed by the insulator housing; and further comprising removing, prior to any exposure of charging current or fusing, at least a portion of said temporary input/output terminal connector from between said input/output terminals.

13. The method of claim 10, wherein removing an amount of the temporary joint portion, prior to any exposure of charging current or fusing, sufficient to sever electrical conductivity through the temporary joint portion between the battery-side bus bar portion and the alternator-side bus bar portion includes leaving behind at least one temporary joint portion remnant, and wherein said at least one temporary joint remnant is located at least partially inside the recessed portion defined by structure of the insulator housing.

14. The method of claim 10, wherein said temporary joint portion includes a pair of legs, one such leg on each of the battery-side bus bar portion and the alternator-side bus bar portion, with a connecting structure joining said pair of legs to one another;

wherein partially covering the circuit board with the insulator housing includes forming an electrically insulative projecting structure on said insulator housing and between said legs of said temporary joint portion; and wherein removing an amount of the temporary joint portion, prior to any exposure of charging current or fusing, sufficient to sever electrical conductivity through the temporary joint portion between the battery-side bus bar portion and the alternator-side bus bar portion includes leaving behind at least a portion of said legs of said temporary joint portion with said insulative projecting structure located between said legs.

* * * * *